US006302492B1

(12) United States Patent
Loer

(10) Patent No.: US 6,302,492 B1
(45) Date of Patent: Oct. 16, 2001

(54) DEVICE FOR PICKING BRISTLE-LIKE FILL MATERIALS

(75) Inventor: Werner Loer, Wünnenberg (DE)

(73) Assignee: Wöhler Techische Bürsten Maschinenbau GmbH, Wünnenberg (DE)

( * ) Notice: Subject to any disclaimer, the term of this patent is extended or adjusted under 35 U.S.C. 154(b) by 0 days.

(21) Appl. No.: 09/423,188

(22) PCT Filed: Feb. 3, 1999

(86) PCT No.: PCT/DE99/00281

§ 371 Date: Nov. 3, 1999

§ 102(e) Date: Nov. 3, 1999

(87) PCT Pub. No.: WO99/44467

PCT Pub. Date: Sep. 10, 1999

(30) Foreign Application Priority Data

Mar. 3, 1998 (DE) ..... 198 08 883

(51) Int. Cl.[7] ..... A46D 1/08
(52) U.S. Cl. ..... 300/7; 300/5
(58) Field of Search ..... 300/4, 5, 7, 18, 300/21

(56) References Cited

U.S. PATENT DOCUMENTS

| | | | | |
|---|---|---|---|---|
| 532,735 | * | 1/1895 | Kimball | 300/5 |
| 544,201 | * | 8/1895 | Young | 300/5 |
| 1,752,926 | * | 4/1930 | Page | 300/7 |
| 2,211,036 | * | 8/1940 | Vinal | 300/7 |
| 3,048,442 | | 8/1962 | Anderson . | |

FOREIGN PATENT DOCUMENTS

| | | |
|---|---|---|
| 1 632 375 | 11/1970 | (DE) . |
| 196 03 392 | 8/1997 | (DE) . |
| 2 11/635 | 7/1983 | (GB) . |

* cited by examiner

*Primary Examiner*—Terrence R. Till
(74) *Attorney, Agent, or Firm*—Cohen, Pontani, Lieberman & Pavane

(57) ABSTRACT

A picking device used for separating a fill material. The picking device includes a magazine for holding the fill material. The magazine has a width defined by two movable lateral walls and a depth defined by a two-piece stationary bottom which has an upper surface for sustaining the fill material. The two pieces of the bottom are spaced apart so as to form a discharge slot for releasing the fill material from the magazine. The lateral walls are movable so that they swing relative to the stationary bottom within a swing range to facilitate discharge of the fill material through the slot.

11 Claims, 1 Drawing Sheet

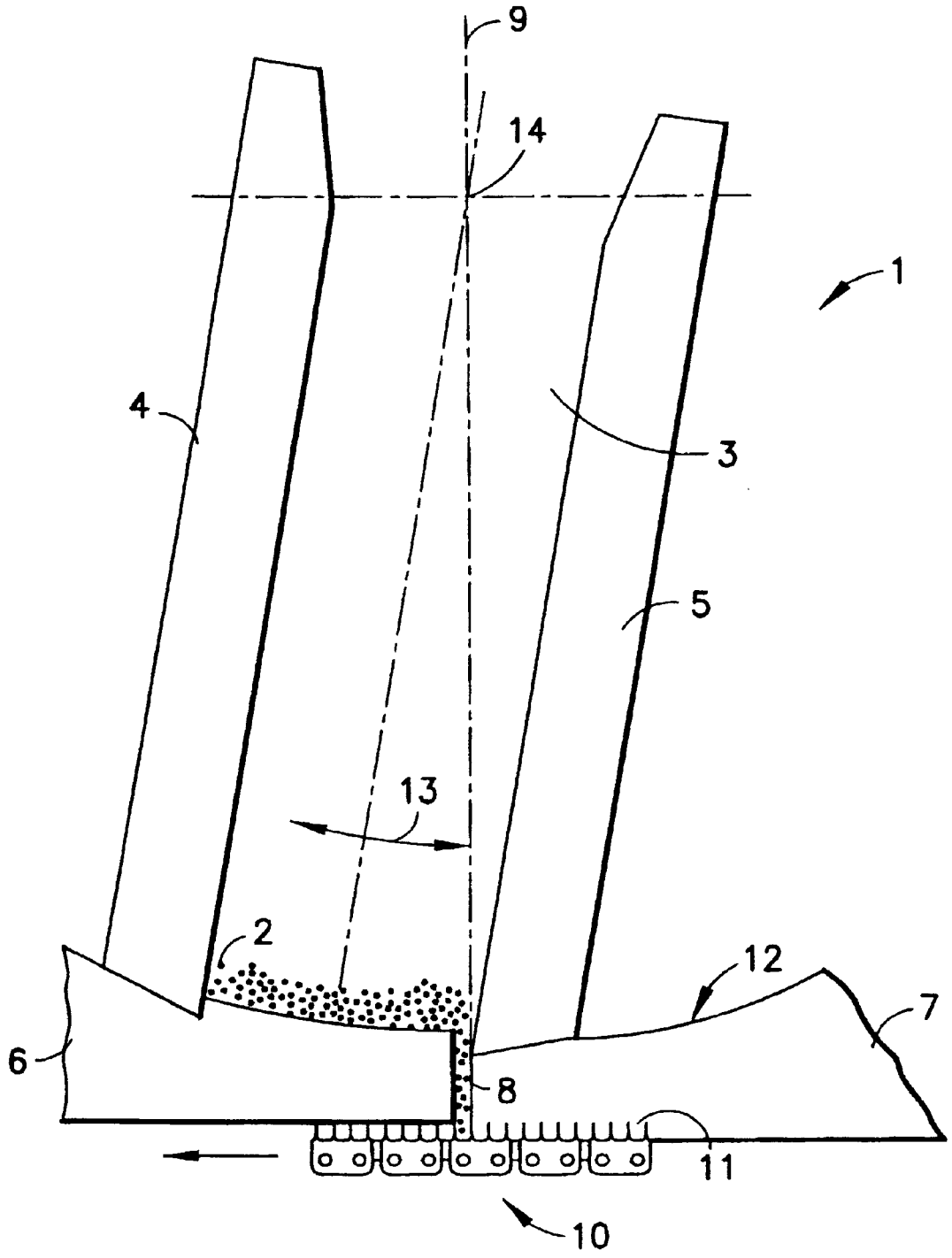
9
14
1
4
3
5
13
2
12
7
6
8
11
10

DEVICE FOR PICKING BRISTLE-LIKE FILL MATERIALS

BACKGROUND OF THE INVENTION

1. Field of the Invention

This invention relates to a picking device, in particular for the separating of fill material for the production of brushes, such as for example strip brushes.

2. Description of the Prior Art

In a system made public in U.S. Pat. No. 3,048,442 the fill materials, to be separated, such as fill bristles for example, are separated by means of gearwheel-like circular blades in the inter-teeth notches. This, however, gives rise to an undesired compacting of the fill material so that trouble free operation is no longer possible, i.e. such a system leads to frequent stoppages. The shown constellation of circular blades in the aforementioned publication means that it is also possible to place a continuous fleece of fill material with that system, for instance onto a conveyor chain.

Also known from DE-OS No. 1,632,375 is a sledge provided with notches, which is fed past a magazine above it that is open at the bottom. Herewith the notches are filled with fill material, which is then taken over by a conveyor system.

Common to both these systems is the need for the notches to be kept closed during transport of the fill material within them, so that the fill material cannot escape from the notches. As this is realised by contact with guides these systems further lead to an undesired generation of heat and hence to resultantly high levels of abrasion.

Furthermore, the actual separator is in both cases fed along the stationary magazine above it and totally open at the bottom, in order to receive the fill material.

A generic device is known from DE reference No. 196, 03,392. This system shows a separator with notch which is fed in pendulum fashion beneath a stationary magazine during the picking process. A return stroke, i.e. null or empty stroke, is required each time, leading to long cycle times and thus resulting in considerable economic drawbacks. Here too, the guide, in holding the fill material within the notch, gives rise to undesired heat generation and abrasion and finally to malfunctioning of the system and high maintenance costs. The said system shows several magazines open at the bottom placed side by side to one another and in all forming a rigid construction. Changing of the magazine is possible by swinging the complete magazine constellation above the picker, which also goes to form the lower base of a magazine, even during a movement. Other magazines are to be separately closed at the bottom.

SUMMARY OF THE INVENTION

One object of this invention is thence to provide a picking device, in particular for the separating of fill material for the production of brushes, such as strip brushes for example, with which neither compacting of the material to be separated nor long cycle times and undesired heat generation result. It is a further object, to provide a picking device with which the material to be separated can be discharged in both separated quantities as well as in the form of a continuous fleece, where required.

A picking device of the present invention, has a magazine with movable lateral walls which during the discharge of the fill material move in horizontally swinging and/or back and forth motion over at least two stationary arranged fittings, that the two fittings are placed at a distance apart from one another, forming between them an open picking slot, through which the fill material passes when being carried away, in order to allow it to be fed on to further processing.

Herewith results that there is absolutely no contact of wearing parts on the picking device of this invention nor any increased generation of heat and likewise do neither compacting of the material nor null strokes arise. What is more, the picking device of this invention allows an increased production speed at a high level of operational reliability and all this without abrasion in the areas of the material discharge and separating devices.

Furthermore, the configuration of the picking device of this invention allows a high level of variability in respect of production speed and with a simultaneously high level of discharge reliability.

If the picking slot is developed so that it is adjustable in size and is formed by at least two fittings placed at a distance apart from each other and whose position to one another is made adjustable, then the possibility is given to handle, i.e. to discharge by means of the picking device of this invention, diverse fill material, i.e. fill material of different size and/or thickness for example, with the picking device of this invention in a most simple manner and without any considerable change over work being required. What is more, differently sized material, i.e. material of different diameters for example, can be processed by simple adjustment of the picking slot.

If the lateral limitations of the magazine are formed to terminate at least in part at a distance beneath the base area of the magazine and/or the lateral limitations of the magazine are formed to terminate at least in part laterally to the fittings at a distance beneath the base area, then this will allow the material to be fed to the picking slot without resulting in direct contact between the lateral limitations and the supports, i.e. those fittings forming the base of the magazine, so that no abrasion at all occurs in this area.

If a conveyor placed beneath the picking slot to accept and convey the emerging fill material is provided, then this will ensure that the fill material can continuously leave the magazine through the picking slot without requiring a cyclical processing.

BRIEF DESCRIPTION OF THE DRAWINGS

FIG. 1 schematically shows a case example of the picking device of this invention, in particular for the separating of fill material for the production of strip brushes.

DETAILED DESCRIPTION OF THE PREFERRED EMBODIMENT

As can be seen from this figure the picking device of this invention is constructed as a swinging picker 1.

This has a fill material 2, in the case shown fill bristles, holding magazine 3, which is defined in its width by lateral limitations 4,5 and has a support 6,7, in the case shown of two part construction, at its lower discharge side that has a partial pitch circle shape toward the magazine.

The two support forming parts 6,7 are placed with their facing sides at a distance apart from one another, so that a picking slot 8 results, which in the case shown is placed symmetrically, i.e. co-axially, to the magazine centre 9.

Beneath the support 6, 7, in particular beneath the picking slot 8, there is in the case shown a conveyor device 10, which accepts the fill bristles 2 emerging from the picking slot 8 and in the case shown is constructed as a chain with separators, i.e. notches 11, which separate the fill bristles 2 emerging from the picking slot 8.

The respective lateral limitation 4,5 is made up in the case shown of two parts, i.e. it consists in the case shown of two guides each fed laterally past the support 6,7 and terminating at a distance beneath the pitch circle shaped support 6,7, i.e. beneath the magazine face 12.

In this connection it is likewise conceivable to make the respective lateral limitations 4,5 for example of one part construction, in such a manner that these have a U-shaped form solely in the area of the support 6,7, so that the legs of the U-piece project beyond the magazine face 12, as here shown.

As can be seen from the figure the corner points of the lateral limitations 4,5 facing the magazine 3 thereby terminate at a greater distance to the magazine face 12 than the corner points of the lateral limitations 4,5 facing away from the magazine 3.

Furthermore, it can be seen from the figure that the magazine 3, with the fill material 2 held within it, is so constructed that the lateral limitations 4,5 and therewith the magazine 3 can be moved in a back and forth motion in the direction of the arrow 13, i.e. pendulum motion, about the centre line 9 and therewith the slot 8.

Furthermore, it can be seen from the figure that the sides of the lower supports 6,7 facing away from the magazine 3 are, in the case shown, placed at a different level.

That is to say that the side of the right hand part 7, seen from viewing the figure, of the support 6,7, facing away from the magazine 3 terminates, on viewing the figure, beneath the level of the side of the left hand part 6, seen from viewing the figure, of the support 6,7, facing away from the magazine 3.

In operation the magazine 3 would be filled with relevant fill materials, such as fill bristles 2 for example, and the magazine 3 then brought into a back and forth motion in the direction of the arrow 13, so that the fill material 2 present in the magazine 3 leaves, by means of gravity and/or a pressure system, not here shown, the magazine 3 through the picking slot 8 and is taken up by the conveyor 10 beneath it, in this case the conveyor 10 with notches 11, and fed on for further processing.

In a further case example the front and rear side of the magazine 3, seen from viewing the figure, is cased, i.e. at least in part closed, by a relevant fitting, whereby the front-to-back size of the magazine is at least equal to that of the respective fill material length.

It is likewise conceivable in a further example to dispense with the here for example shown chain conveyor 10 and instead to place for example a band beneath the picking slot 8, so that the material 2 present in the magazine 3 can be removed as a continuous or rather densely laid fleece.

Moreover, it is likewise conceivable to arrange the parts 6,7, i.e. the support 6,7, in adjustable fashion, so that the picking slot 8 can be made adjustable in its size according to requirements as well as that the speed of the back and forth motion can be made adjustable, thus resulting in a different discharge speed of the fill 2 present in the magazine 3.

Furthermore, it would be conceivable to intermittently remove from the magazine 3 the fill material 2 present in it, i.e. either for example by the constellation of several slots 8 or by means of relevant separating devices such as for example the possibility of a controlled picking slot closure, so that in each case the fill material 2 can only intermittently leave the magazine 3 through the picking slot 8.

Finally, it is conceivable not to place merely one magazine 3, as here shown, but rather a number of magazines 3 about the swinging axis 14 for example, which could then for example be filled with various materials 2 which can be held in the magazine 3 during a circular rotary motion of the magazines 3 by, for example, a plunger, here not shown, whereby it would be conceivable not to form the support face 12 with a partial pitch circle but rather round with one or more picking slots 8, so that each of the magazines 3 placed on a circular area may be brought into use, i.e. through a relevant back and forth motion or even through a circulatory motion, i.e. rotary motion, whereby in each case that magazine 3 coming into operation with the picking slot 8 discharges the fill material 2 present within it.

What is claimed is:

1. A picking device used for separating a fill material, comprising a magazine for holding the fill material, said magazine having a width defined by two movable lateral walls and a depth defined by a two-piece stationary bottom which has a upper surface for sustaining the fill material, the two pieces of the bottom being spaced apart so as to form a discharge slot for releasing the fill material from said magazine, said lateral walls being movable in that they swing relative to said stationary bottom within a swing range to facilitate discharge of the fill material through said slot.

2. The picking device of claim 1, wherein the lateral walls are configured to be movable in a back-and-forth motion which occurs in a straight line.

3. The picking device of claim 1, wherein the lateral walls are configured to execute a rotary motion.

4. The picking device of claim 1, wherein sides of the two pieces facing the magazine form the bottom of the magazine.

5. The picking device of claim 1, where said upper surface of said stationary bottom has a partial pitch circle shape.

6. The picking device of claim 1, wherein said lateral walls extend at least partially below the upper surface of said stationary bottom.

7. The picking device of claim 1, wherein said lateral walls terminate at least partially laterally to the bottom pieces at a distance below the upper surface.

8. The picking device of claim 1, which further comprises a conveyor situated at a distance beneath a lower surface of said stationary bottom for receiving and carrying away the fill material emerging from said discharge slot.

9. The picking device of claim 8, wherein said conveyor includes at least one separator for portioning the fill material discharged from said slot.

10. The picking device of claim 9, wherein said separator is a notch.

11. The picking device of claim 8, where said conveyor is constructed to continuously take up the fill material and spread it out as a fleece.

* * * * *